US007673566B2

(12) United States Patent
Han et al.

(10) Patent No.: US 7,673,566 B2
(45) Date of Patent: Mar. 9, 2010

(54) METHOD FOR USE IN A WELLBORE

(75) Inventors: Chenghua Han, Sugar Land, TX (US); Mark C. Duhon, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/334,915

(22) Filed: Dec. 15, 2008

(65) Prior Publication Data

US 2009/0090263 A1 Apr. 9, 2009

Related U.S. Application Data

(62) Division of application No. 11/308,464, filed on Mar. 28, 2006, now Pat. No. 7,481,166.

(51) Int. Cl.
*F42B 3/00* (2006.01)
*F42D 3/00* (2006.01)

(52) U.S. Cl. ..... 102/312; 102/313; 102/318; 102/704

(58) Field of Classification Search ..... 89/36.01, 89/36.02, 36.03, 36.04, 36.07, 36.08, 36.09, 89/36.12, 36.17; 102/312, 313, 314, 316, 102/318, 704
See application file for complete search history.

(56) References Cited

U.S. PATENT DOCUMENTS

| | | | | | |
|---|---|---|---|---|---|
| 1,565,766 | A | * | 12/1925 | Weber | 102/313 |
| 2,273,166 | A | * | 2/1942 | Allen | 102/382 |
| 2,501,766 | A | * | 3/1950 | Fieser et al. | 102/365 |
| 2,674,945 | A | * | 4/1954 | Marsh | 102/202.12 |
| 2,939,778 | A | * | 6/1960 | McKinley | 206/222 |
| 3,491,687 | A | * | 1/1970 | Cholet | 102/318 |
| 4,637,312 | A | * | 1/1987 | Adams et al. | 102/275.12 |
| 4,727,808 | A | * | 3/1988 | Wang et al. | 102/202.5 |
| 5,589,657 | A | * | 12/1996 | Gessel et al. | 102/202.14 |
| 6,336,408 | B1 | * | 1/2002 | Parrott et al. | 102/312 |
| 6,520,258 | B1 | * | 2/2003 | Yang et al. | 166/297 |
| 6,554,081 | B1 | * | 4/2003 | Brooks et al. | 175/4.54 |

* cited by examiner

*Primary Examiner*—Bret Hayes
(74) *Attorney, Agent, or Firm*—Rodney Warfford; Kevin B. McGoff; Trop, Pruner & Hu PC

(57) ABSTRACT

An apparatus for use in a wellbore comprises a heat insulating container having an inner space and having a structure defining a hollow containing a vacuum. The apparatus further comprises a reflective layer arranged on a surface of the heat insulating container to reflect heat for reducing radiated heat originated in the wellbore from reaching the inner space. Also, a signal-activated detonator is provided in the inner space of the heat insulating container.

10 Claims, 3 Drawing Sheets

METHOD FOR USE IN A WELLBORE

This application is a divisional of U.S. application Ser. No. 11/308,464, filed Mar. 28, 2006, incorporated herein by reference.

TECHNICAL FIELD

The invention relates generally to a heat insulating container for a detonator.

BACKGROUND

Temperatures deep in wellbores typically can reach relatively high levels, sometimes reaching well over 500° F. To perform operations in a well, various types of tools are lowered into the well. These tools often include heat-sensitive components, such as electrical detonators. An electrical detonator is used for detonating explosives (such as shaped charges in perforating guns).

Many commercially available detonators are rated to operate at less than 500° F. for a relatively limited amount of time (such as one hour or so). With the oil and gas industry continuing to explore wells at ever deeper depths, the temperatures and pressures experienced by downhole tools can be quite high. The result is that many commercially available detonators will fail in high-temperature applications. Normally, a perforating job can take many hours to complete, in which the perforating tool, including an electrical detonator, remains downhole for such time. If the electrical detonator were to fail as a result of high temperature, then well operations may not be performed reliably, which can lead to increased well completion times (and thus increased costs), and reduced production of hydrocarbons.

SUMMARY OF THE INVENTION

In general, according to an embodiment, an apparatus for use in a wellbore comprises a heat insulating container containing a space and having a structure defining a vacuum. A reflective layer is arranged on a surface of the heat insulating container to reflect heat, and a signal-activated detonator is provided in the space of the heat insulating container.

Other or alternative features will become apparent from the following description, from the drawings, and from the claims.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
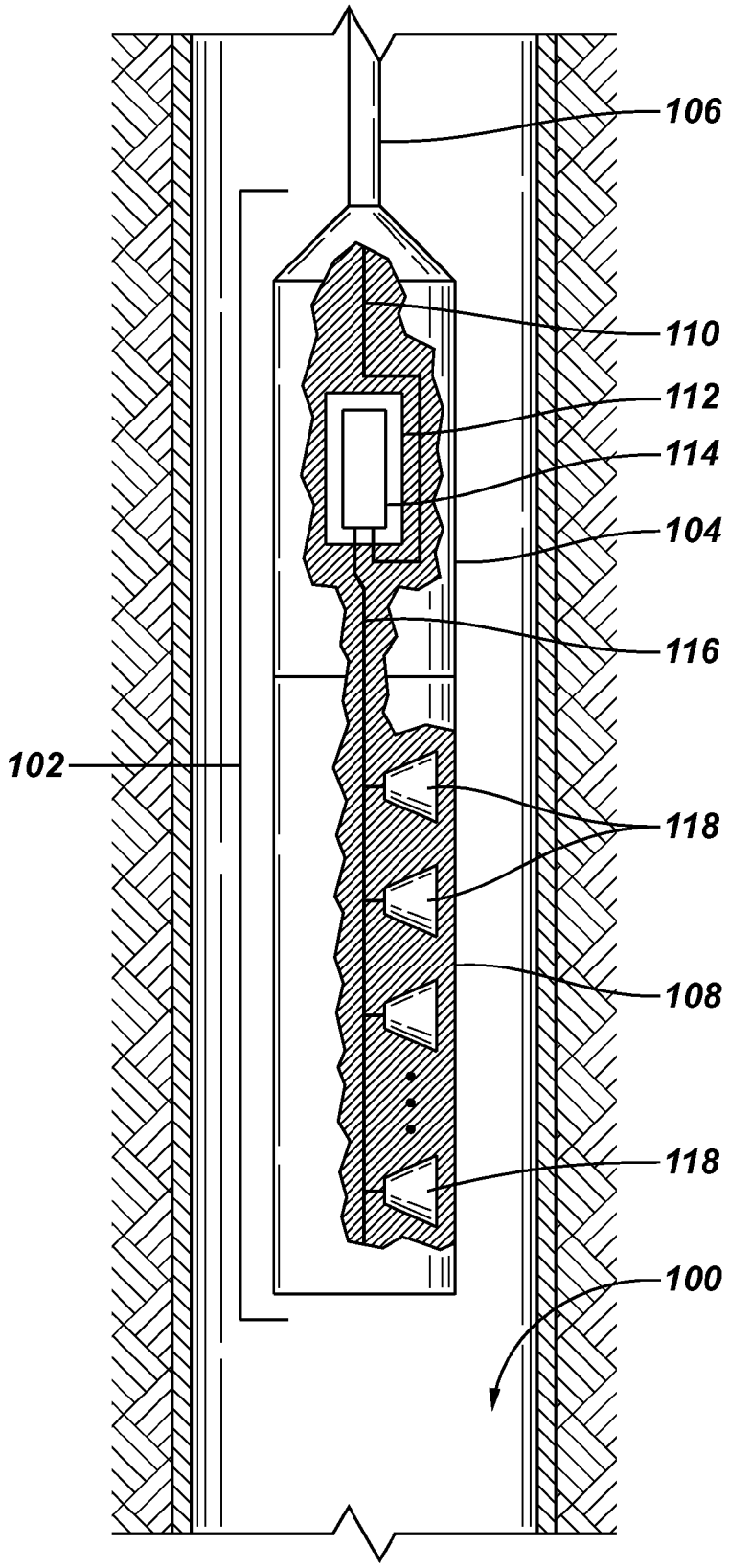
FIG. 1 illustrates an example perforating tool that includes an embodiment of the invention.

FIG. 1 illustrates a perforating tool 102 that is positioned downhole in a wellbore 100. The perforating tool 102 is carried by a carrier line 106, which can be a wireline, slickline, coiled tubing, and so forth. The perforating tool 102 includes a firing head 104 and a perforating gun 108. In other embodiments, other components can be part of the perforating tool 102, such as casing collar locators, sensing modules, and so forth.

The firing head 104 includes a heat insulating container 112 according to an embodiment. The heat insulating container 112 contains a signal-activated detonator 114. A "signal-activated detonator" refers to any detonator that is activated in response to an electrical stimulus (electrical power or signaling), optical signaling, or pressure pulse signaling for exploding an explosive. Pressure pulse signaling refers to a sequence of pressure pulses having a predetermined pattern that is detectable as a signature by the detonator for activation of the detonator. A detonator that is activated by an electric stimulus is also referred to as an electrical detonator.

Although only one detonator 114 is shown as being contained in the heat insulating container 112, it is contemplated that in other embodiments, multiple detonators can be provided inside the heat insulating container 112. In yet further embodiments, multiple heat insulating containers 112 can be provided in the firing head 104 for containing respective detonators.

The detonator 114 is coupled to one or more electrical wires 110 that are electrically connected to a cable (e.g., electrical cable) in the carrier line 106. The detonator 114 is activated in response to electrical stimulus in the electrical wire(s) 110. Alternatively, a fiber optic cable can be carried by the carrier line 106, with a converter provided in the firing head 104 or elsewhere in the tool 102 to convert between optical signals and electrical signals. In yet another embodiment, the carrier line 106 does not need to include a cable if pressure pulse signals are used for activation of the detonator 114. In such an embodiment, the firing head 104 or other component would include a pressure transducer to detect a predefined sequence of pressure pulse signals.

In one embodiment, the one or more electrical wires 110 and carrier line cable communicate electrical power and signaling between the detonator 114 and a controller that can be located elsewhere in the wellbore 100 or at the earth surface from which the wellbore 100 extends. Power and signaling communicated down the cable in the carrier line 106 and through the one or more wires 110 to the detonator 114 causes activation of the detonator 114, which in turn causes initiation of a detonating cord 116 that is ballistically coupled to the detonator 114. The detonating cord 116 extends from the detonator 114 to shaped charges 118 (or other types of explosives) in the perforating gun 108. In other implementations, other types of components including explosives can be used with the detonator 114. Effectively, the detonating cord 116 ballistically connects the detonator 114 to the explosives.

In the embodiment of FIG. 1, the one or more electrical wires 110 and detonating cord 116 both extend from the bottom end of the heat insulating container 112. In an alternative embodiment, the one or more electrical wires 110 can extend into the heat insulating container 112 at the top end, while the detonating cord 116 can extend through the bottom end of the heat insulating container 112.

The heat insulating container 112 provides heat insulation for reducing heat transfer by conduction, convection, and radiation between the wellbore environment and an inner space of the heat insulating container 112 that contains the detonator 114. Heat transfer by conduction is performed through solids; heat transfer by convection is performed through fluids, such as air or liquid; and heat transfer by radiation is transfer of heat by emission of electromagnetic waves.

To reduce heat conduction or convection, the heat insulating container 112 contains a structure that defines a vacuum between the wellbore environment around the perforating tool 102 and the inner space of the heat insulating container 112. The structure of the heat insulating container 112 that provides the vacuum can be a wall (or walls) of the heat insulating container 112 that define(s) a hollow area for storing or providing the vacuum. In some embodiments, the heat insulating container 112 is formed of glass, such as Pyrex® glass or silicate glass. Pyrex® glass refers to heat-resistant borosilicate rolled glass.

In accordance with some embodiments, heat transfer by radiation is reduced by providing one or more reflective layers (in the form of coatings on respective surfaces) in the heat insulating container 112 to reflect heat originated or produced in the wellbore environment away from the inner space of the container 112. Note that the tool 102 can be positioned downhole in a wellbore environment having elevated temperatures (such as in the range between 400-600° F.) for extended periods of time (such as greater than one hour). The heat insulating container 112 protects the detonator 114 from elevated wellbore temperatures that may cause damage to the detonator 114.

Figure 2:
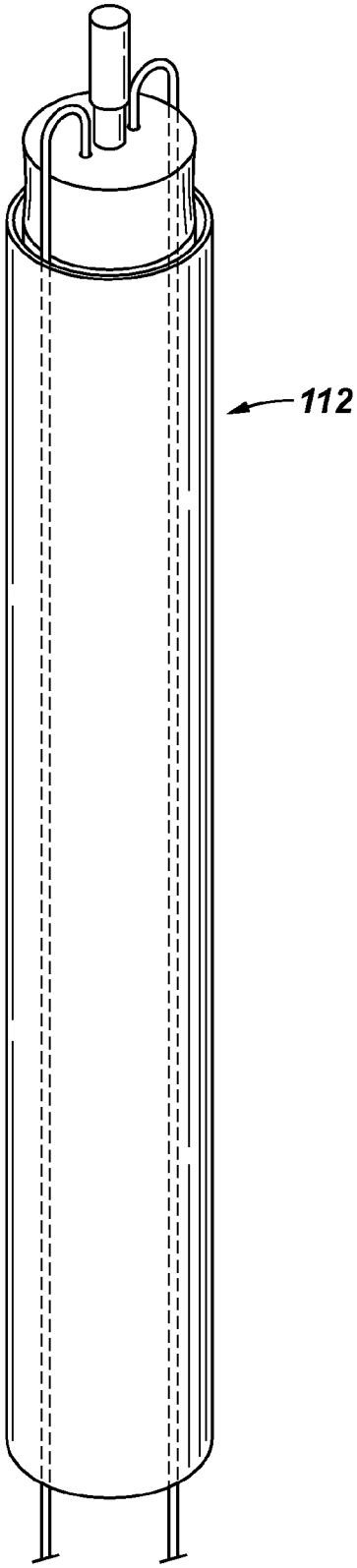
FIG. 2 is a perspective view of an assembly including a heat insulating container and a signal-activated detonator, according to an embodiment.
Figure 3:
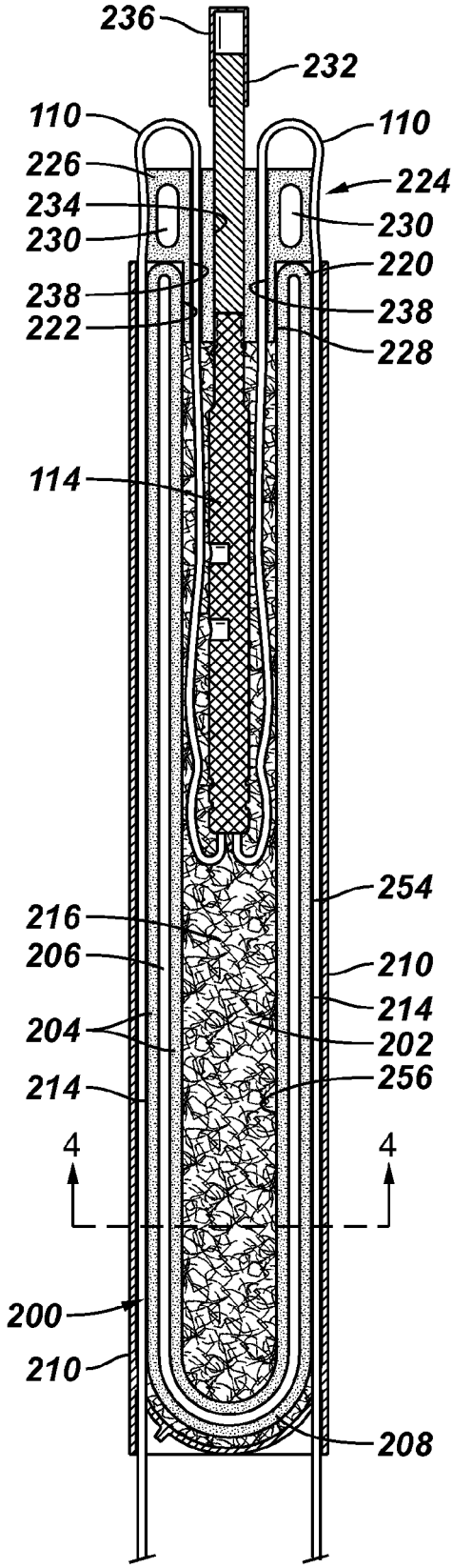
FIG. 3 is a side cross-sectional view of the assembly including the heat insulating container and the detonator contained in the heat insulating container, in accordance with an embodiment.

FIG. 2 is a perspective view of the heat insulating container 112. In the depicted embodiment, the heat insulating container 112 has a generally cylindrical shape. In other embodiments, the heat insulating container 112 can have other shapes. Reference is made to FIGS. 2 and 3 in the following discussion, in which FIG. 3 depicts a longitudinal sectional view of the heat insulating container 112 along section 2-2.

The heat insulating container 112 includes a thermal flask 200 (e.g., a Dewar flask) that has an inner space 202 in which the detonator 114 is provided. The thermal flask 200 has a wall 204 (e.g., a glass wall) or walls that define(s) a hollow area 206 containing a vacuum. The hollow area 206 is sealed by the wall(s) 204 of the thermal flask 200. The hollow region 206 provides a vacuum layer along the side of the thermal flask 200 and at a first end 208 of the thermal flask 200. This vacuum layer reduces heat conduction and convection.

In some embodiments, the detonator 114 is a miniaturized detonator (as discussed further below) so that a large and bulky thermal flask does not have to be provided to receive the detonator 114. This allows the insulating container 112 according to some embodiments to be used with existing tools without having to redesign or significantly modify the designs of such tools.

The thermal flask 200 is positioned inside a protective outer shell 210 of the heat insulating container 112. The outer shell 210 can be formed of a metal (e.g., aluminum) or other material to protect the thermal flask 200 from damage during use. A filler layer 214 is provided between the thermal flask 200 and the outer shell 210. The filler layer 214 can be formed of a fiberglass or other heat-insulating material to provide relatively good insulation between the outer shell 210 and the thermal flask 200.

A filler mass 216 (which can also be formed of fiberglass or other heat insulating material) is provided in a portion of the inner space 202 of the thermal flask 200. The filler mass 216 generally surrounds the detonator 114 so the filler mass 216 separates the detonator 114 from the inner surface of the thermal flask 200. The filler mass 216 acts to prevent the detonator 114 from bouncing around or otherwise moving inside the inner space 202 of the thermal flask 200 during transportation or deployment into a well, which may cause damage to the detonator 114. Damage may occur if the detonator 114 were allowed to repeatedly and directly impact a hard object such as the thermal flask 200.

Figure 4:
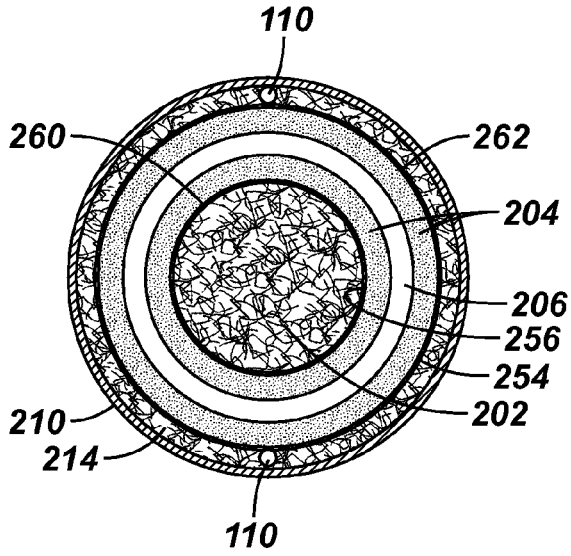
FIG. 4 is a cross-sectional view of the heat insulating container of FIG. 2.

One or more surfaces of the thermal flask 200 can be coated with a reflective material (e.g., silver, gold, mercury, or even bright color paint such as white paint) to reflect radiated heat from the wellbore environment. The term "bright color paint" refers to any paint that is able to reflect a substantial amount of heat as opposed to absorbing the heat. Coating a surface with the reflective material causes a heat reflective layer to be adhered to the surface. In one embodiment, each of the outer surface 254 of the thermal flask 200 and the inner surface 256 of the thermal flask 200 can be coated with a respective layer of reflective material. Alternatively, surfaces of the outer shell 210 can also be coated with the reflective material layer. FIG. 4 is a cross-sectional view showing the various layers of the assembly depicted in FIG. 3. As depicted in FIG. 4, a first reflective layer 260 is arranged on the inner surface 256 of the thermal flask 200, and a second reflective layer 262 is arranged on the outer surface 254 of the thermal flask 200.

By using the vacuum layer provided by the thermal flask 200 to reduce heat conduction and convection and the reflective layer(s) to reduce radiated heat, the rate at which temperature in the inner space 202 of the heat insulating container 112 increases due to elevated wellbore temperature is reduced.

Electrical wires 110 extend from the detonator 114 to a second end 220 of the thermal flask 200, where an opening 222 is defined through which the detonator 114 can be inserted into the inner space 202 of the thermal flask 200. Once the detonator 114 is inserted into the inner space 202 of the thermal flask 200, a plug 224 is sealably fitted into the opening 222 of the thermal flask 200 to seal the inner space 202 of the thermal flask 200 from the outside of the thermal flask 200. The plug 224 has an enlarged head portion 226 and a shaft 228 that extends from the enlarged head 226. The shaft 228 has an outer diameter that is generally the same as the inner diameter of the opening 222 at the top portion of the thermal flask 200 such that a snug fit can be provided between the plug 224 and the thermal flask 200. The plug 224 is formed of a glass, such as a Pyrex® glass or other type of silicate glass. The plug 224 includes a hollow region 230 (or plural hollow regions) that contain(s) a vacuum for improved heat insulation. Additionally, the plug 224 can also be coated with reflective layers to reflect heat away from the inner space of the thermal flask 200.

The plug 224 has a first through-bore 234 that allows a detonating cord 232 to pass from the detonator 114 to a location outside the thermal flask 200. One end of the detonating cord 232 is attached to a crimp shell 236 that is crimped (by radially inward compression) to the detonating cord 232. The crimp shell 236 can be attached to another detonating cord (such as detonating cord 116 of FIG. 1).

The plug 224 also includes additional through-bores 238 through which the electrical wires 110 extend between the inside of the thermal flask 200 and the outside of the thermal flask 200. The wires 110 wrap around and extend in a space between thermal flask 200 and the outer shell 210.

The plug 224 is sealingly engaged with the thermal flask inner surface with high temperature insulation sealants. Also, the detonating cord 232 and wires 110 are sealing engaged in respective through-bores 234 and 236 with high temperature insulation sealants.

In operation, the tool 102 (FIG. 1) is lowered into the wellbore 100, such as to a high temperature environment, where the tool 102 can be positioned for an extended time period prior to activation of the detonator 114. Stimulus is then communicated over the carrier line cable and wires 110 to activate detonator 114, which in turn causes initiation of the detonating cord 232. Initiation of the detonating cord causes a detonating wave to be communicated through the detonating cord 232 and the attached detonating cord 116 to cause detonation of explosive(s), such as the shaped charges 118 of the perforating gun.

By using the heat insulating container according to some embodiments, the various heat sensitive components of the detonator 114 are protected from a potentially high heat wellbore environment. Such protection increases the reliability and life of the detonator 114 so that a wellbore operation can be successfully completed.

Figure 5:
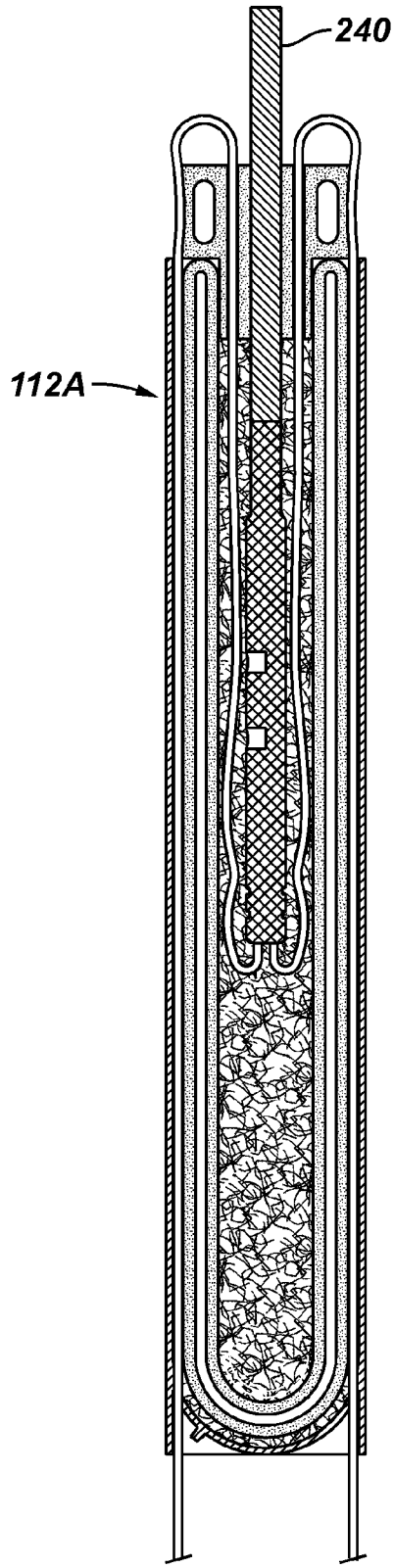
FIG. 5 is a side cross-sectional view of another assembly including a heat insulating container and a detonator, according to another embodiment.

FIG. 5 shows a heat insulating container 112A according to another embodiment. The heat insulating container 112A is the same as the heat insulating container 112 except that the detonating cord 232 of FIG. 3 is replaced with a hollow crimp tube 240 in FIG. 4. The hollow crimp tube 240 is used during transportation. At the well site, a well operator inserts a booster explosive into the inner bore of the crimp tube 240 until the booster explosive abuts the end of the detonator 114. The detonating cord 116 (FIG. 1) can then be inserted into the remaining portion of the crimp tube 240, with the crimp tube 240 crimped against the detonating cord 116 for attaching the detonating cord 116. Alternatively, the booster explosive can be omitted, with the detonating cord 116 inserted into the crimp tube 240 to ballistically connect to the detonator 114.

Figure 6:
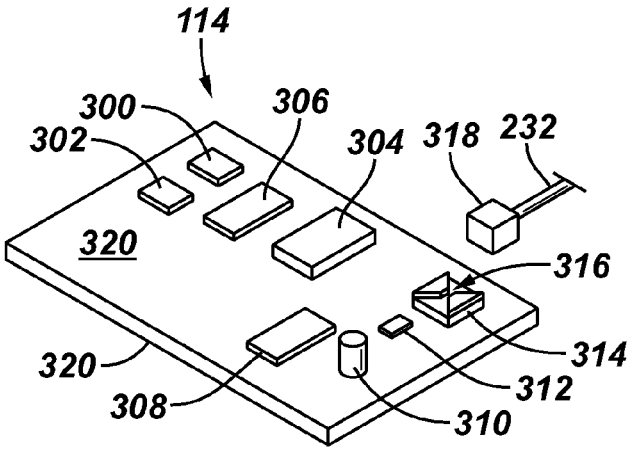
FIG. 6 illustrates an electrical detonator, according to an embodiment.

FIG. 6 shows a portion of the detonator 114, according to an example embodiment. The detonator 114 includes a support substrate 320 (e.g., a circuit board, a flex cable, and so forth) on which various components are mounted. The components mounted on the support substrate 320 include a receiver 300 and a transmitter 302 for communicating over the wires 110 (FIG. 2). A power supply 304 is also provided on the support substrate 320, where the power supply 304 supplies power to the various components on the support substrate 320. A microprocessor 306 is also provided on the support substrate 320, where the microprocessor is capable of receiving control signaling over the wires 110 (FIG. 2) that include commands to actuate the detonator 114. The microprocessor 300 can be a general purpose, programmable integrated circuit (IC) microprocessor, an application-specific integrated circuit (ASIC), a programmable gate array (PGA), or other control device.

A multiplier 308 is also provided on the support substrate 320, where the multiplier 308 receives an input voltage from the electrical wires 110 and multiplies the input voltage by some amount to produce an output voltage that is greater than the input voltage. For example, the multiplier 308 can be a charge pump that takes the input voltage and steps the input voltage to a higher output voltage. The output voltage provided by the multiplier 308 is supplied to an energy source 310 (such as a capacitor) that is capable of storing the voltage provided by the multiplier 308. Also, the energy source 310 is coupled through a switch 312 to an initiator 314. The switch 312 is controlled by the microprocessor 306

In response to an activation command, the microprocessor 306 closes the switch 312 to enable the charge in the energy source 310 to be provided to the initiator 314 to activate the initiator 314. Assuming that the initiator 314 is implemented as an EFI (exploding foil initiator), then closing of the switch 312 causes a rapid electrical discharge to be provided from the energy source 310 to the EFI 314, which causes a bridge structure 316 in the EFI 314 to rapidly change to a plasma and generate a high pressure gas, thereby causing a "flyer" to accelerate and impact a secondary explosive 318 to cause detonation of the explosive 318. Detonation of the explosive 318 causes initiation of the detonating cord 232 (or booster explosive).

The detonator 114 depicted in FIG. 6 is an example of a miniaturized detonator since many of the components of the detonator 114 are mounted on the support substrate 320.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method for use in a wellbore, comprising:

lowering a tool having a heat insulating container and an explosive into the wellbore, wherein the heat insulating container has an opening and an inner space and a structure defining a vacuum layer, the tool further having:

a reflective layer arranged on a surface of the heat insulating container to reflect heat for reducing heat radiation from the wellbore into the inner space, a signal-activated detonator provided into the inner space through the opening of the heat insulating container, a plug including a hollow that has a vacuum and the plug to fit into the opening to seal the inner space, and a filler mass inside the inner space to separate the detonator from an inner surface of the heat insulating container to protect the detonator from direct impact between the detonator and the heat insulating container, wherein the filler mass is formed of a heat insulating material; and activating the signal-activated detonator to cause detonation of the explosive.

2. The method of claim 1, wherein the tool is lowered to a depth in the wellbore at which the temperature is between 400° F. and 600° F.

3. The method of claim 2, wherein the tool remains in the wellbore in an environment with temperature between 400° F. and 600° F. for longer than one hour prior to activation of signal-activated detonator for detonating the explosive.

4. The method of claim 1, further comprising providing the reflective layer coated to the surface of the heat insulating container.

5. The method of claim 1, wherein lowering the tool having the heat insulating container comprises lowering the tool having the heat insulating container that comprises a thermal flask that provides the inner space in which the signal-activated detonator is provided.

6. The method of claim 1, wherein the detonator includes one of an exploding foil initiator, an exploding bridgewire initiator, a hot-wire detonator, and a semiconductor bridge detonator.

7. A method for use with a wellbore, comprising:

providing a tool having a heat insulating container and an explosive, wherein the heat insulating container has an inner space and a structure defining a vacuum layer, the tool further having a reflective layer arranged on a surface of the heat insulating container to reflect heat for reducing heat radiation from the wellbore into the inner space, and a signal-activated detonator provided in the inner space of the heat insulating container, and wherein the heat insulating container has an opening;

inserting the signal-activated detonator into the heat insulating container through the opening; and inserting a plug to fit in the opening to seal the inner space in which the signal-activated detonator is provided, wherein the plug includes a hollow that has a vacuum;

lowering the tool into the wellbore; and activating the signal-activated detonator to cause detonation of the explosive.

8. The method of claim 7, further comprising:

extending a crimp tube through a through-bore of the plug;

inserting booster explosive into the crimp tube such that the booster explosive abuts the detonator;

ballistically connecting a detonating cord to the booster explosive in the crimp tube; and crimping the crimp tube around the detonating cord to attach the detonating cord to the heat insulating container.

9. The method of claim 7, wherein the detonator is responsive to one of an electrical stimulus, fiber optic signaling, and pressure pulse signaling.

10. The method of claim 7, wherein the hollow of the plug is separate from the hollow of the structure.

* * * * *